US005403256A

United States Patent [19]

Squires

[11] Patent Number: 5,403,256

[45] Date of Patent: Apr. 4, 1995

[54] AEROBIC APPARATUS

[76] Inventor: Bernardo Z. Squires, 3450 Irving Ave. South, Minneapolis, Minn. 55408

[21] Appl. No.: 147,921

[22] Filed: Nov. 5, 1993

[51] Int. Cl.[6] ..... A63B 21/00

[52] U.S. Cl. ..... 482/91; 482/92; 482/148

[58] Field of Search ..... 482/135, 117, 126, 106, 482/54, 70, 71, 146, 73, 91; 135/910, 911

[56] References Cited

U.S. PATENT DOCUMENTS

| | | | |
|---|---|---|---|
| 3,807,727 | 4/1974 | Ferguson | 482/71 |
| 3,904,198 | 9/1975 | Jones . | |
| 4,236,544 | 12/1980 | Osaka | 235/911 |
| 4,257,591 | 3/1981 | Evans, Sr. | 482/91 |
| 4,376,532 | 3/1983 | Hunstad | 482/71 |
| 4,402,506 | 9/1983 | Jones | 482/71 |
| 4,466,610 | 8/1984 | Israel . | |
| 4,572,500 | 2/1986 | Weiss | 482/112 |
| 4,700,945 | 10/1987 | Rader | 482/72 |
| 4,750,736 | 6/1988 | Watterson | 482/73 |
| 5,022,648 | 6/1991 | Travis . | |
| 5,064,190 | 11/1991 | Holt | 482/70 |
| 5,078,389 | 1/1992 | Chen | 482/147 |
| 5,139,471 | 8/1992 | Dornberger . | |

FOREIGN PATENT DOCUMENTS

| | | | |
|---|---|---|---|
| 1075029 | 2/1960 | Germany | 482/129 |
| 2655215 | 6/1978 | Germany | 135/910 |

*Primary Examiner*—Richard J. Apley
*Assistant Examiner*—Jerome Donnelly
*Attorney, Agent, or Firm*—Leone & Moffa

[57] ABSTRACT

An exercise apparatus provides support and coordination of exercise motions to the user. The exercise apparatus has two exercise bars, two short exercise bars, a stabilizing bar, and a device for coupling the two exercise bars or the two short exercise bars at one end. The exercise bars have removable hand grips for helping the user maintain a grip on the exercise bar, wrist straps to provide for a level of safety when exercising with others when the grip is lost on the exercise bar, and a shoe that mounts on the stabilizing bar. One or both of the exercise bars may include lights mounted along the length of the bar. The lights provide an apparatus to help the instructor and user determine the position of the bar in space and also provide aesthetic appeal. The stabilizing bar attaches securely to the floor, and includes recesses for mounting the exercise bar. The stabilizing bar attaches to the floor and provides a stable point of reference. The coupling device joins the two exercise bars at the top, while allowing the lower ends to be secured to the stabilizing bar. The coupling device allows both exercise bars to be used in unison, to allow for greater stability and a different set of exercise motions.

15 Claims, 6 Drawing Sheets

AEROBIC APPARATUS

This invention relates to a device for exercising and conditioning and toning and more particularly to a staff having hand grips and various manipulatable attachments to aid in exercise.

BACKGROUND OF THE INVENTION

Aerobic exercises are useful for toning and conditioning the body. Various equipment have been introduced for the purpose of aiding and assisting aerobic exercise. The prior art shows various bar devices for use during aerobic exercise.

For example, the prior art shows Steve Travis U.S. Pat. No. 5,022,648 entitled "AEROBIC WAND". Travis recites an aerobic device formed of an elongated tube having sections joined together by cylindrical centrally located springs. The tube contains a moveable rod that may be displaced into and out of the cylindrical spring using a detent mechanism. When the rod is within the spring the elongated tube section forms a rigid bar, and when the spring mechanism is operable the tube section may be pivoted about a central pivot. The aerobic wand shows use of rubber cups and a rigid hand grip.

Terry P. Israel U.S. Pat. No. 4,466,610 entitled "EXERCISE CLUB" describes a exerciser for assisting a user in performing stretching, isomeric, isotonic and isokinetic exercises which may be combined with various aerobic activities such as walking or jogging. The club has the shape of an elongated cylindrical shaft with knobs serving as hand grips. The knobs are rounded so that the user grips the knobs with the palm resting on the outer ends while the fingers curve around the edges of the knob. The club also has various gripping surfaces for the hand, fingers, and thumb.

Russell P. Jones U.S. Pat. No. 3,904,198 entitled "EXERCISE BAR" describes a exercise bar with a pair of shafts at each end. The shafts are threaded in order to support weight plates. Freely rotatable hand grips are positioned on the bar on the opposite ends to permit weights to move in a complete circle around the bar.

U.S. Pat. No. 5,139,471 entitled "MINI-GYM FOR EXERCISING THE LIMBS" discloses a ball and ramp device. The user rolls the ball up the ramp toward a bell target. Hand supports are available for support if needed. The exercise device is portable and is useful for people with a limited range of movement.

While the prior art shows various devices for use in exercise, muscle development, stretching exercises, aerobics, calisthenics and other similar activities, the prior art does not show a bar constructed to help the user to coordinate those activities. The prior art also does not show an apparatus used to combine more than one bar to help stabilize the user during aerobic exercise. In particular, an aerobic workout may be aided by a bar that is useful for both stabilizing the user and assisting in certain aerobic movements.

It is therefore a motivation of the invention to provide an exercise apparatus that provides for support and coordination of exercising motions.

SUMMARY OF THE INVENTION

The invention provides an exercise bar comprising a bar with two opposing ends covered by a special fixture that is inserted into a stabilizer platform. The special fixtures provide secure mounting on the stabilizer platform when the user leans on the exercise bar. The invention also provides a shorter exercise bar comprising a short bar having two opposing ends covered by a special fixture and having a handgrip at each end. The short bar provides for specifically different exercises than the exercise bar, providing for a greater range of aerobic workouts. The user grasps the exercise bar at the ends over a foam pad or using a flexible hand grip formed from a loop or belt suspended from each end of the bar. More than one bar may be employed with a union cup. The union cup is used to couple the ends of two of the exercise bars. The exercise bars may be used freely or be secured to the stabilizer platform. The exercise bar may also include optional lights for aesthetic appeal or to aid an instructor in teaching exercises to a-student. The lights are located along the length of the bar and at one end, and are controlled by a switch.

It is one object of the invention to provide an exercise apparatus that provides stability and a greater range of motion during exercise.

It is another object of the invention to provide an exercise apparatus that provides coordination of exercise motions.

It is yet a further object of the invention to provide an exercise apparatus that includes lights for aiding an instructor during training exercises in teaching the user and for aesthetic purposes and for use as a rhythmic gymnastic tool.

Other objects, features and advantages of the present invention will become apparent to those skilled in the art through the description of the preferred embodiment, claims and drawings herein wherein like numerals refer to like elements.

BRIEF DESCRIPTION OF THE DRAWINGS

To illustrate this invention, a preferred embodiment will be described herein with reference to the accompanying drawings.

DETAILED DESCRIPTION OF THE PREFERRED EMBODIMENT

Figure 1:
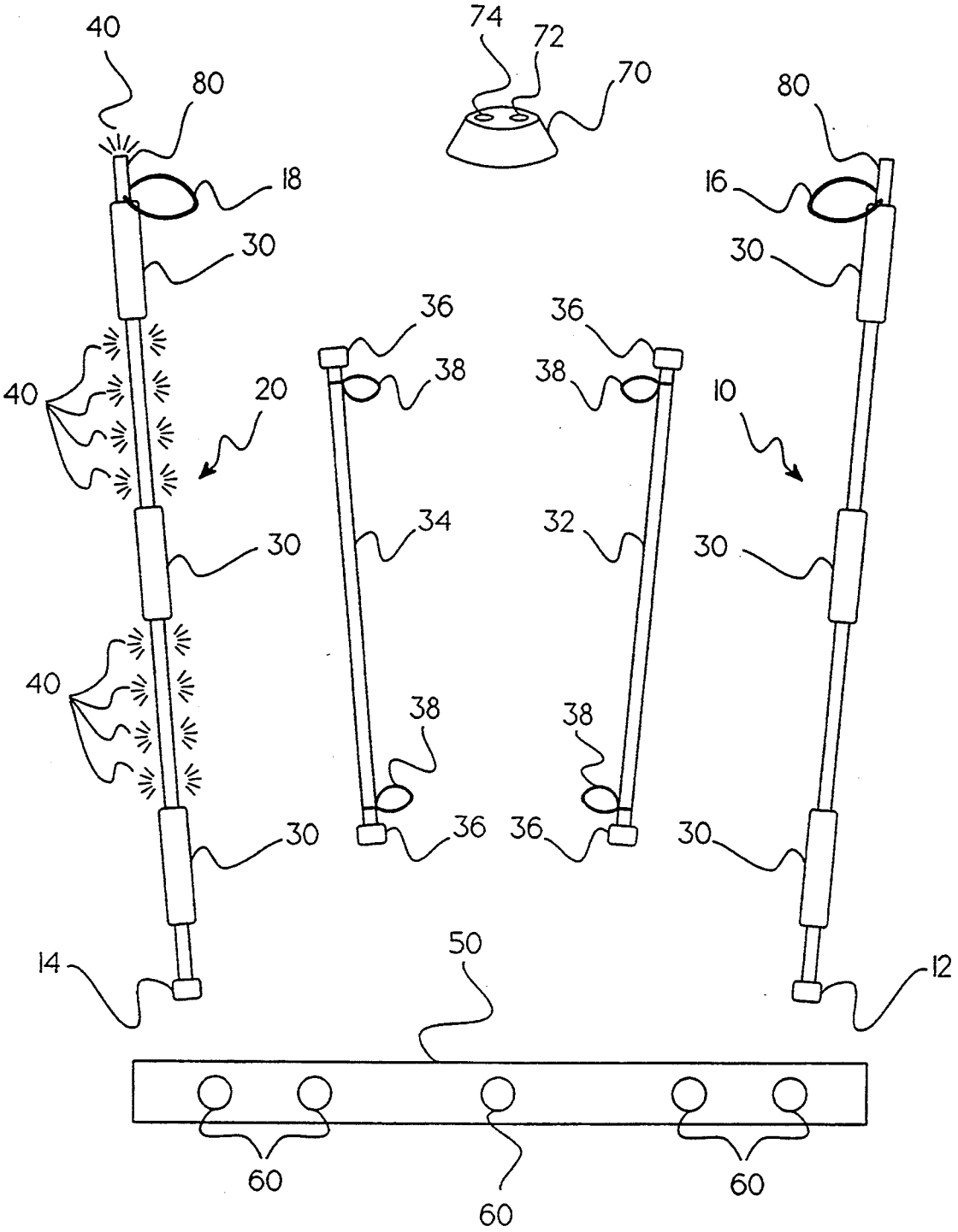
FIG. 1 shows a perspective view of the apparatus of the invention.

Referring now to FIG. 1, FIG. 1 shows a perspective view of one preferred embodiment of the apparatus of the invention. The invention has two exercise bars 10, 20, two short exercise bars 32, 34, a stabilizing bar 50, and a union cup 70. The exercise bars 10, 20 have shoes 12, 14 that fit over a first end of the exercise bars 10, 20. The shoes 12, 14 provide a stable base for the exercise bars 10, 20 when placed on a floor or when placed on the stabilizing bar 50. The exercise bars 10, 20 also have hand grips 30. The hand grips 30 are attached to the exercise bars 10, 20 to provide the user with a more secure grip to the exercise bars 10, 20 during the exercise motions. The exercise bars 10, 20 also have wrist straps 16, 18 that loop around the wrist of a user. The wrist straps 16, 18 attach the exercise bars 10, 20 to the user in the event that the user loses hold of one of the exercise bars 10, 20 to prevent the exercise bars 10, 20 from striking other users.

The short exercise bars 32, 34 function similarly to the exercise bars 10, 20 and have shoes 36 and wrist straps 38. The shoes 36 fit over ends of the short exercise bars 32, 34 and provide a stable base for the short exercise bars 32, 34 when placed on the floor or on the stabilizing bar 50. The wrist straps are attached to the ends of the short exercise bars 32, 34 and secure the short exercise bars 32, 34 to the wrists of the user to prevent the short exercise bars 32, 34 from striking other users.

The stabilizing bar 50 attaches to the floor and provides a stable mounting for the exercise bars 10, 20 and short exercise bars 32, 34. The stabilizing bar has a plurality of recesses 60 that are fitted to receive the shoes 12, 14 of the exercise bars 10, 20 and the shoes 36 of the short exercise bars 32, 34. The first ends of the exercise bars 10, 20 may be placed in any combination of the plurality of recesses 60 on the stabilizing bar 50 that is comfortable for the user and is suitable for a particular exercise. The ends of the short exercise bars 32, 34 may also be used within a combination of the plurality of recesses 60 on the stabilizing bar 50. The plurality of recesses 60 allows for a stable positioning of the exercise bars 10, 20 and short exercise bars 32, 34 while allowing the exercise bars 10, 20 and short exercise bars 32, 34 to pivot around the recess 60.

The union cup 70 allows for coupling of the second ends 80 of the exercise bars 10, 20. The union cup 70 has two holes 72, 74 fitted to receive the second ends 80 of the first and second exercise bars 10, 20. The holes 72, 74 form an acute angle such that when the second ends 80 of exercise bars 10, 20 are inserted in the holes 72, 74, the first ends of exercise bars 10, 20 fit into a pair of the plurality of recesses 60 in stabilizing bar 50.

Figure 2A:
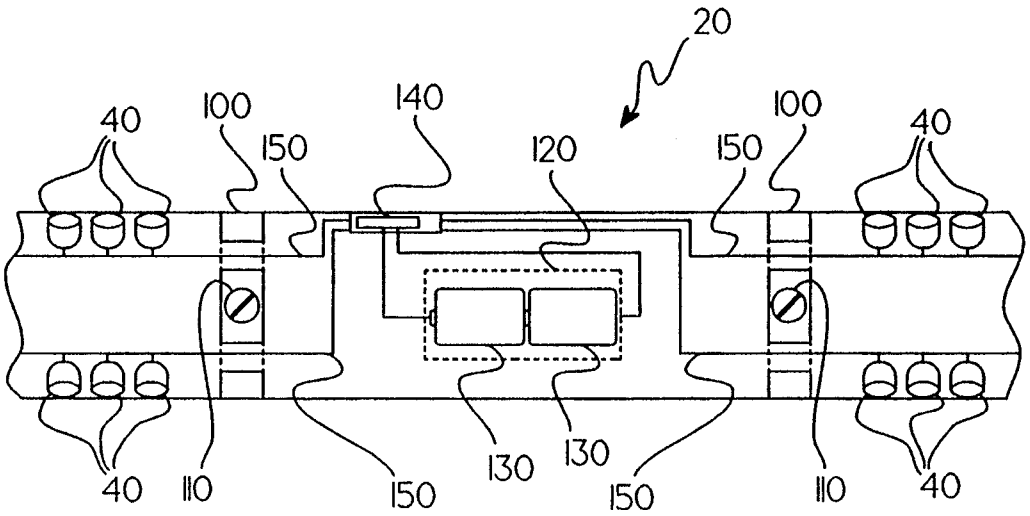
FIG. 2A shows a partial side view of one example of the lighting elements of the exercise bar of the apparatus of the invention.

FIG. 2A illustrates a partial side view of one example of the lighting elements of the exercise bar 20 of the apparatus of the invention. The exercise bar 20 includes a lighting system. The lighting system comprises a power source 130, lights 40, and switch 140. The power source, which in this embodiment comprises batteries 130, are held within a compartment 120, which is recessed into exercise bar 20 so that the cover of compartment 120 is flush with the surface of exercise bar 20. The power supply from the batteries 130 is controlled by a switch 140, which is also mounted flush along the surface of the exercise bar 20. The switch 140 has several wires 150 leading to the lights 40. The wires 150 are connected to switch 140, pass through a plurality of coupling joints 100 and are connected to a plurality of lights 40. The lights 40 are mounted along the length of the exercise bar 20 flush with the surface of the exercise bar 20. When the switch 140 is in the "ON" position, power is supplied to the lights 40, and when switch 140 is in the "OFF" position, power is not supplied to the lights 40.

Figure 2B:
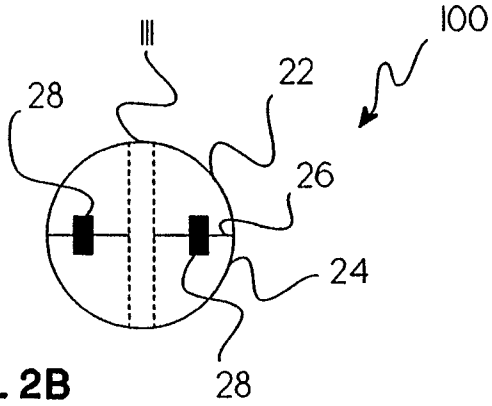
FIG. 2B shows a front view of the coupling joint of the exercise bar of the apparatus of the invention.

FIG. 2B shows a front view of one of the coupling joints 100 of the exercise bar 20 of the apparatus of the invention. The exercise bar 20 is split down the length of the exercise bar 20 and comprises two halves 22, 24. The two halves 22, 24 are held together by the plurality of coupling joints 100. The coupling joint 100 has a screw hole 111 adapted to receive a screw or other fastening means which passes through and joins both halves 22, 24 of the exercise bar 20. The coupling joint 100 also has two notches 28 that allow the wires 150 of switch 140 to pass along the length of the exercise bar 20.

Figure 3:
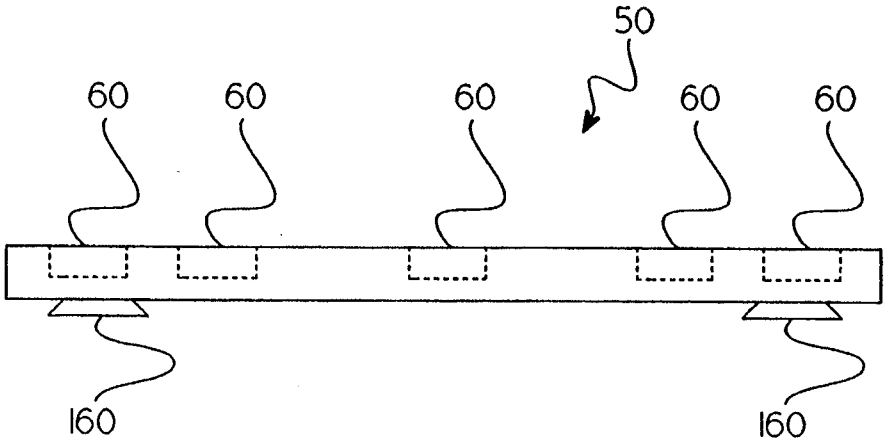
FIG. 3 shows a side view of the stabilizing bar of the apparatus of the invention.

FIG. 3 shows a side view of the stabilizing bar 50 of the apparatus of the invention. The stabilizing bar 50 rests on a plurality of feet 160, which in one preferred embodiment may comprise one foot 160 at each corner. The feet 160 provide a support for the stabilizing bar 50, and may advantageously comprise rubber suction cups to allow for secure attachment to a floor. The stabilizing bar 50 also has a plurality of recesses 60. The shoes 12, 14 of the exercise bars 10, 20 and the shoes 36 of the short exercise bars 32, 34 fit within the plurality of recesses 60, while allowing the exercise bars 10, 20 and short exercise bars 32, 34 to pivot around the recesses 60.

Figure 4:
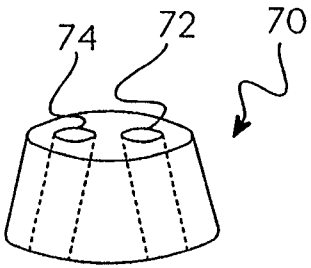
FIG. 4 shows a side view of the union cup of the apparatus of the invention.

FIG. 4 shows a side view of the union cup 70 of the apparatus of the invention. The union cup 70 functions to couple the exercise bars 10, 20 together. The union cup 70 has two holes 72, 74 fitted to receive the second ends 80 of the exercise bars 10, 20. The holes 72, 74 are angled so that the shoes 12, 14 of the first ends of exercise bars 10, 20 may be placed in a pair of recesses 60 on the stabilizing bar 50.

Figure 5B:
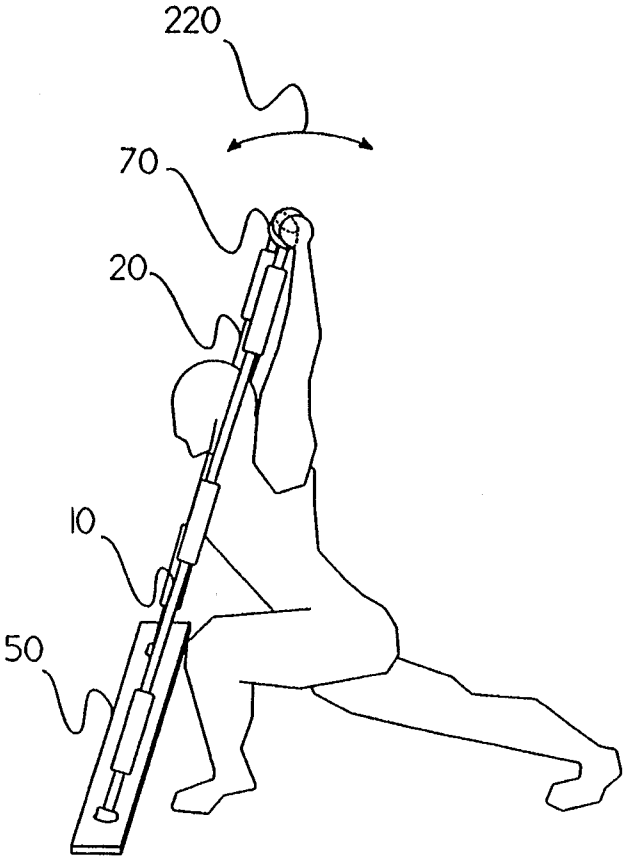
FIGS. 5A, 5B, 5C, and 5D show perspective views of some possible uses of the apparatus of the invention.
Figure 5A:
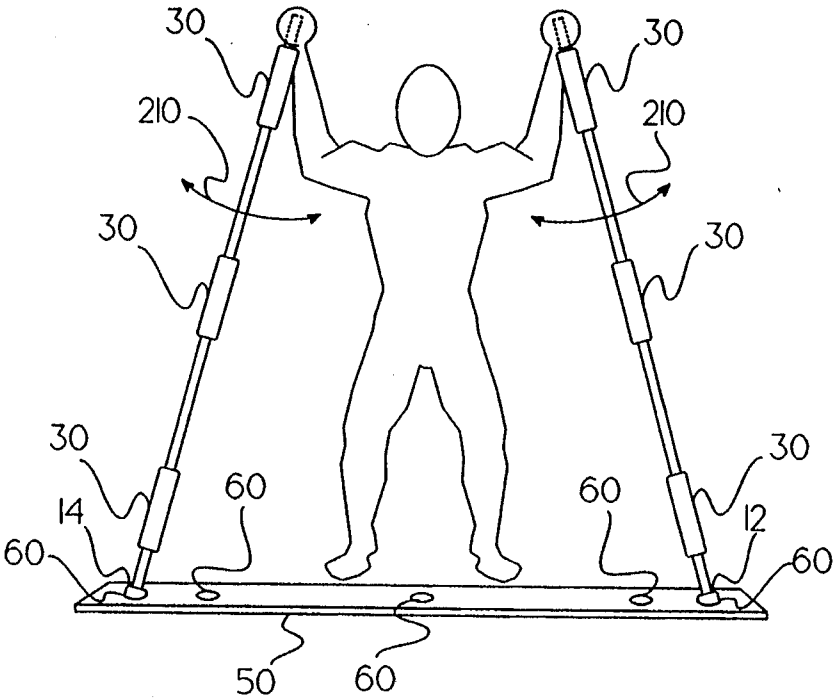

FIGS. 5A, 5B, 5C, and 5D show perspective views of some possible uses of the apparatus of the invention. FIG. 5A shows a perspective view of the exercise bars 10, 20 employed in an aerobic exercise. The shoes 12, 14 of exercise bars 10, 20 are placed on the stabilizing bar 50 within a pair of the plurality of recesses 60. The user moves exercise bars 10, 20 through a range of motion indicated by double-headed arrows 210.

FIG. 5B shows a use of the apparatus of the invention employing the union cup 70. The second ends 80 of the exercise bars 10, 20 are inserted into the union cup 70. The user 200 grasps the union cup 70 and moves the exercise bars 10, 20 through a rowing motion in the directions of a double headed arrow 220.

Figure 5D:
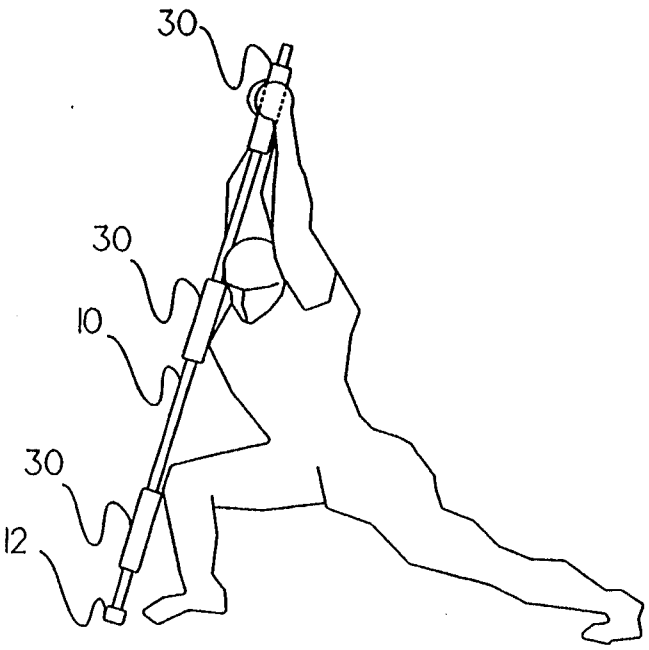
Figure 5C:
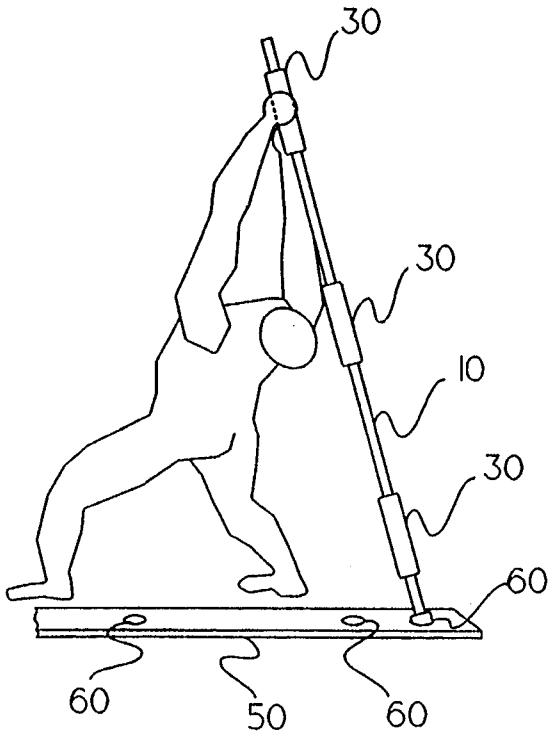

FIGS. 5C and 5D demonstrate the use of the exercise bars 10, 20 in stretching exercises. The user grasps exercise bar 10 by the handgrip 30 to provide stability during stretching. The exercise bar 10 may be placed within one of the plurality of recesses 60 on the stabilizing bar 50, or may rest upon the ground on the shoe 12.

Figure 6A:
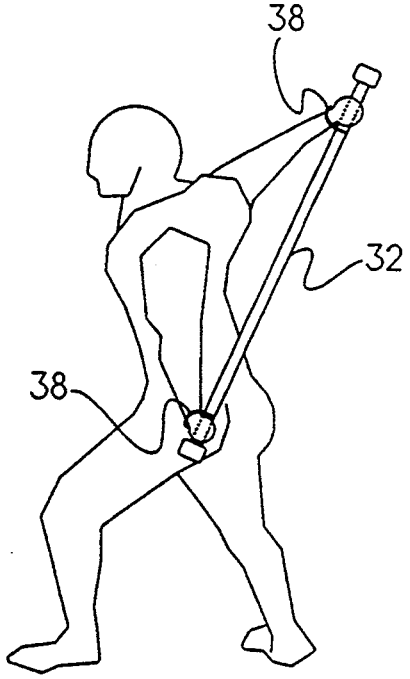
FIGS. 6A, 6B, 6C, and 6D show perspective views of some possible uses of the short exercise bars of the invention.
Figure 6B:
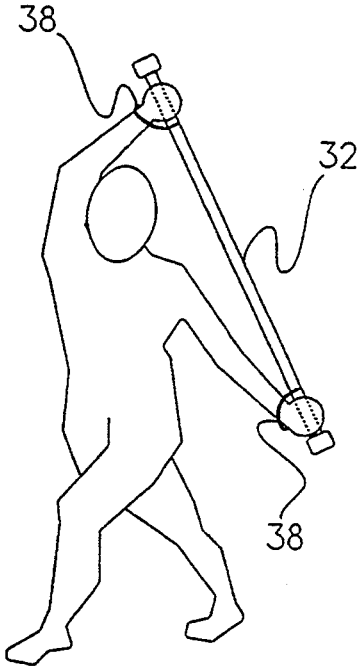
Figure 6C:
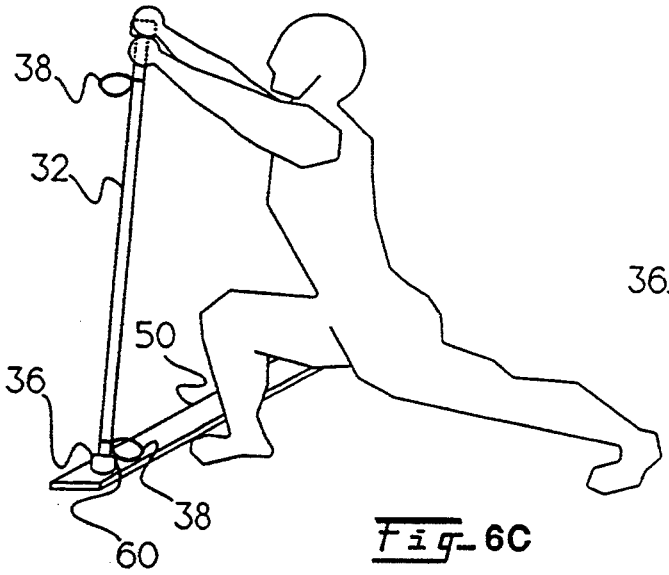
Figure 6D:
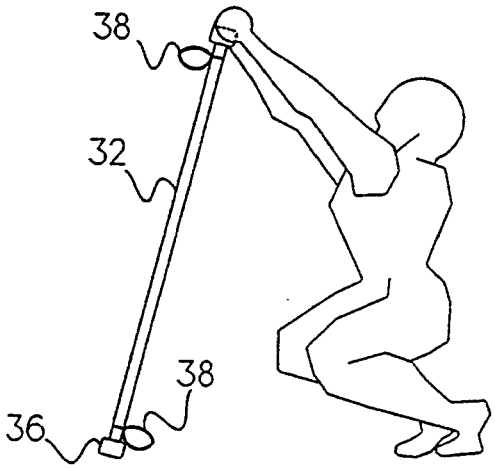

FIGS. 6A, 6B, 6C, and 6D show perspective views of some possible uses of the short exercise bar of the invention. The user grasps the short exercise bar 32 on opposing ends. The wrist straps 38 are looped around the wrists of the user. The short exercise bar 32 may then be moved through a variety of aerobic exercises, as demonstrated in FIGS. 6A and 6B. The short exercise bar 32 may also be used in combination with the stabilizing bar 50 by placing the shoes 36 of the short exercise bar 32 within a pair of the plurality of recesses 60 on the stabilizing bar 50, as illustrated in FIG. 6C. The shoe 36 of the short exercise bar 32 provides a firm attachment to the floor for various other exercises, as shown in FIG. 6D.

The invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. An exercise apparatus for providing support and coordination of motion to a user, the exercise apparatus comprising:

(a) a first exercise bar and a second exercise bar, each exercise bar having a first end and a second end;

(b) a stabilizing means having a plurality of mounting means for quickly securing a first end of the first exercise bar and a first end of the second exercise bar while allowing the exercise bars to be pivoted around the mounting means and allowing the exercise bars to be quickly removed; and (c) a connecting means that allows for quick engagement and disengagement of a second end of the first exercise bar and a second end of the second exercise bar, where the connecting means engages the bars so that the bars are disposed at an acute angle flaring outwardly to couple with the stabilizing means, wherein the connecting means is capable of being gripped by the user with both hands.

2. The exercise apparatus of claim 1 where the exercise apparatus further comprises a first short exercise bar and a second short exercise bar, the first short exercise bar and the second short exercise bar having a length shorter than the first exercise bar and the second exercise bar.

3. The exercise apparatus of claim 2 where the first short exercise bar and the second short exercise bar further comprise:

a) a first end and second end;

b) a pair of shoe means attached to the first end and the second end; and c) a pair of wrist strap means attached to the first end and the second end.

4. The exercise apparatus of claim 1 where the first and second exercise bars further comprise:

a) a hand grip means located at various points along a length of the exercise bar for aiding the user in maintaining a grip on the exercise bar;

b) a wrist strap means attached to a shaft of the exercise bar for securing the exercise bar to the user; and c) a shoe means attached to each first end of the first and second exercise bars to provide secure mounting to the stabilizing means.

5. The exercise apparatus of claim 4 where the hand grip means is attached to the exercise bar by a hook and eye fabric.

6. The exercise apparatus of claim 1 where at least one of the first and second exercise bars further comprise:

a) a lighting means for providing assistance to an instructor while teaching the user and for aesthetic purposes during exercise; and b) a first and second elongated members detachable from each other along a length of at least one exercise bar to provide access to an interior of the at least one exercise bar to allow for repair.

7. The exercise apparatus of claim 6 where the lighting means further comprises:

a) a plurality of lights mounted flush along a shaft and at the second end of the exercise bars;

b) a power supply means contained within the shaft of the exercise bars for providing power to the plurality of lights; and c) a switch mounted flush on a surface of the exercise bars for controlling a supply of power from the power supply means to the plurality of lights.

8. The exercise apparatus of claim 7 where the plurality of lights comprises a series of light emitting diodes mounted flush along the shaft and at the second end of the exercise bars.

9. The exercise apparatus of claim 7 where the plurality of lights comprises a series of fluorescent lamps mounted flush along the shaft and at the second end of the exercise bars.

10. The exercise apparatus of claim 7 where the plurality of lights comprises a series of incandescent lamps mounted flush along the shaft and at the second end of the exercise bars.

11. The exercise apparatus of claim 7 where the power supply means comprises a plurality of batteries.

12. The exercise apparatus of claim 1 where the stabilizing means comprises a plank having a plurality of recesses where each one of the plurality of recesses is fitted to receive one of the first end of the first exercise bar or the first end of the second exercise bar while allowing the first and second exercise bars to be pivoted about a selected one of the plurality of recesses.

13. The exercise apparatus of claim 1 where the stabilizing means comprises a plurality of attachment devices for attaching the stabilizing means to a floor.

14. The exercise apparatus of claim 13 where the plurality of attachment devices comprise a plurality of suction cups.

15. The exercise apparatus of claim 13 where the plurality of attachment devices comprise a plurality of grommets.

* * * * *